US007513580B2

(12) United States Patent
Merrell, II

(10) Patent No.: US 7,513,580 B2
(45) Date of Patent: Apr. 7, 2009

(54) OVERHEAD STORAGE SYSTEM

(76) Inventor: Rodney K. Merrell, II, 450 S. Franklin, Indianapolis, IN (US) 46219

( * ) Notice: Subject to any disclaimer, the term of this patent is extended or adjusted under 35 U.S.C. 154(b) by 0 days.

(21) Appl. No.: 11/827,757

(22) Filed: Jul. 13, 2007

(65) Prior Publication Data

US 2007/0257584 A1 Nov. 8, 2007

Related U.S. Application Data

(63) Continuation of application No. 10/775,367, filed on Feb. 10, 2004, now Pat. No. 7,246,865.

(60) Provisional application No. 60/449,508, filed on Feb. 21, 2003.

(51) Int. Cl.
*A47F 5/08* (2006.01)

(52) U.S. Cl. ..... 312/248; 312/319.5; 4/644

(58) Field of Classification Search ..... 312/242, 312/245, 246, 248, 228, 229, 140.1, 140.2, 312/351.14, 319.5, 319.3; 4/638, 644, 645, 4/630; 52/36.4, 39

See application file for complete search history.

(56) References Cited

U.S. PATENT DOCUMENTS 1,173,828 A * 2/1916 Massie ..... 312/201
1,583,971 A 5/1926 Hammond et al.
1,819,516 A 8/1931 Kelly
2,341,434 A 2/1944 Forbes
2,382,354 A 8/1945 Wales
2,473,239 A 6/1949 Boyd
2,499,791 A 3/1950 Spencer
2,506,086 A 5/1950 Jess
2,592,760 A 4/1952 Sutera
2,679,446 A 5/1954 Weil
3,292,966 A * 12/1966 Mariol ..... 296/168
3,331,645 A 7/1967 Vercellotti
3,415,586 A 12/1968 Hammond
3,464,749 A 9/1969 Bishop
3,467,460 A 9/1969 Acker (Continued)

*Primary Examiner*—James O Hansen
(74) *Attorney, Agent, or Firm*—Maginot, Moore & Beck LLP

(57) ABSTRACT

A storage system for mounting to a ceiling or overhead structure comprises a mounting frame, a storage compartment, a lift mechanism and a tilt mechanism. The mounting frame is mounted to the ceiling or overhead structure. The storage compartment is coupled to the mounting frame for pivotal movement relative to the ceiling or overhead structure between an access position and a storage position. The storage compartment comprises a frame and at least one shelf having a support surface. The shelf is mounted to the frame for pivotal movement relative thereto. The lift mechanism is coupled to the frame of the storage compartment and configured to raise the storage compartment from the access position to the storage position. The tilt mechanism is coupled to the shelf and configured to maintain the support surface of the shelf in a substantially consistent orientation relative to the ceiling when the storage compartment is in the access position, the storage position and positions between the access and storage positions. The storage system may also include an actuator driving the lift and tilt mechanisms to move the storage compartment between the access and storage positions and maintain the relative orientation of the support surface of the shelf during such movement. In specific embodiments the storage compartment may be configured to act as a wet bar or entertainment center.

11 Claims, 11 Drawing Sheets

U.S. PATENT DOCUMENTS 3,502,384 A * 3/1970 Gipson ..... 312/228
3,537,769 A 11/1970 Di Carlo
3,627,396 A * 12/1971 Miller ..... 312/49
3,846,005 A 11/1974 Harper et al.
4,009,918 A * 3/1977 MacDonald et al. ..... 312/351.3
4,026,434 A 5/1977 Howard
4,076,351 A 2/1978 Wyant
4,412,601 A 11/1983 Cooper
4,485,928 A 12/1984 Staashelm
4,616,887 A * 10/1986 Oudman ..... 312/140.1
4,699,437 A 10/1987 Genereaux
4,733,925 A 3/1988 Duran et al.
4,874,211 A 10/1989 Nichols
5,199,843 A 4/1993 Sferra
5,203,619 A 4/1993 Welsch et al.
5,230,109 A * 7/1993 Zaccai et al. ..... 4/645
5,249,858 A 10/1993 Nusser
5,261,645 A 11/1993 Huffman
5,407,261 A 4/1995 Mercer
5,460,280 A 10/1995 Feddeler
5,535,852 A 7/1996 Bishop et al.
5,725,293 A 3/1998 Wilkening et al.
5,772,295 A 6/1998 Sundmark
5,857,756 A 1/1999 Fehre
5,867,847 A * 2/1999 Klawitter et al. ..... 4/645
5,954,410 A 9/1999 Noellert
6,213,575 B1 * 4/2001 Brin et al. ..... 312/140.1
6,250,728 B1 6/2001 Thorp
6,354,682 B1 3/2002 Nott et al.
6,550,878 B2 4/2003 Nott et al.
6,752,475 B2 6/2004 Steadman
2002/0084732 A1 7/2002 Steadman

* cited by examiner

OVERHEAD STORAGE SYSTEM

This application is a continuation of co-pending application Ser. No. 10/775,367, filed on Feb. 10, 2004, which in turn claims the benefit of U.S. Provisional Patent Application No. 60/449,508 filed on Feb. 21, 2003. The disclosure of the two (2) above-identified patent applications are hereby totally incorporated by reference in their entirety.

BACKGROUND AND SUMMARY

The present invention relates to storage systems and more particularly to a storage system having a support surface which is maintained in a specific relative orientation when in a storage configuration, an access configuration and throughout movement between the storage and access configurations.

Storage systems adapted to utilize unused space are well known in the prior art, as shown, for example, in Spencer, U.S. Pat. No. 2,499,791; Vercellotti, U.S. Pat. No. 3,331,645; Hammond, U.S. Pat. No. 3,415,586; Bishop, U.S. Pat. No. 3,464,749; Genereaux, U.S. Pat. No. 4,699,437; Welsch et al., U.S. Pat. No. 5,203,619; Mercer, U.S. Pat. No. 5,407,261; Bishop et al., U.S. Pat. No. 5,535,852; and Thorp, U.S. Pat. No. 6,250,728. In particular, it is known to provide storage systems that when in a storage configuration are located in a cavity in a ceiling or overhead structure and when in an access configuration extend below the ceiling or overhead structure. Some of these known storage systems, such as those disclosed in Vercellotti, Bishop, Genereaux and Mercer, pivot between a stored position and an access position. Other known storage systems, such as those disclosed in Spencer, Hammond, Welsch et al., Bishop et al. and Thorp, translate vertically between a storage position and an access position. Fixed horizontal shelves in the translating systems remain parallel to the floor when in the storage and access positions, as shown, for example, in Welsch et al. It is known to provide a vertical translatable storage system using a motor to translate the storage system between the storage and access positions, as shown, for example in Spencer, Hammond, Welsch et al., and Bishop et al. It is also known to use a parallelogram linkage in a storage system to maintain a shelf in a substantially fixed orientation relative to the floor or ceiling during pivotal movement between a storage position and an access position, as shown, in Genereaux, FIG. 4.

Those skilled in the art will recognize that the displacement between the ceiling and the structural component thereabove, be it another floor or a roof, needs to be larger to facilitate a vertically translatable storage system having the same height as a pivotable storage system. However, the mechanism required to maintain the shelves of a pivotable storage system horizontal is much more complicated than that required in a translatable system.

A pivotable storage system driven by a motor between a storage position and an access position would be appreciated.

According to one aspect of the disclosure, a storage system for selectably providing access to a space above a ceiling and for storing articles therein is provided. The system includes a frame, a support, a pivot mechanism and a motor. The frame is mounted to the ceiling for pivotal movement between a storage position, wherein the frame is disposed substantially within the space, and an access position. The support has a supporting surface. The pivot mechanism couples the support to the frame and is configured to maintain the supporting surface in a substantially fixed orientation relative to the ceiling as the frame is moved between the storage position and the access position. The motor is coupled to the frame and the support and is configured to drive the support between the access position and the storage position and to cooperate with the pivot mechanism to maintain the support surface in the fixed orientation.

According to yet another aspect of the disclosure, a storage system for mounting to a ceiling of a structure is provided. The storage system comprises a mounting frame, a storage compartment, a lift mechanism, a tilt mechanism, and a motor. Portions of the mounting frame are disposed above the ceiling. The storage compartment is coupled to the mounting frame for pivotal movement relative to the ceiling between an access position and a storage position. The storage compartment comprises a frame and at least one shelf having a support surface. The shelf is mounted to the frame for pivotal movement relative thereto. The lift mechanism is coupled to the frame of the storage compartment and configured to raise the storage compartment from the access position to the storage position. The tilt mechanism is coupled to the shelf and configured to maintain the support surface of the shelf in a substantially consistent orientation relative to the ceiling when the storage compartment is in the access position, the storage position and positions between the access and storage positions. The motor drives the lift and tilt mechanisms to move the storage compartment between the access and storage positions and maintain the relative orientation of the support surface of the shelf during such movement.

According to still another aspect of the disclosure, a storage system for mounting to a ceiling of a structure having an electrical supply and a water supply and a floor drain is provided. The storage system comprises a mounting frame, a storage compartment, a lift mechanism, a tilt mechanism, a sink and water supply lines. Portions of the mounting frame are disposed above the ceiling. The storage compartment is coupled to the mounting frame for pivotal movement relative to the ceiling between an access position and a storage position. The storage compartment comprises a frame and at least one shelf having a support surface. The shelf is mounted to the frame for pivotal movement relative thereto. The lift mechanism is coupled to the frame of the storage compartment and configured to raise the storage compartment from the access position to the storage position. The tilt mechanism is coupled to the shelf and configured to maintain the support surface of the shelf in a substantially consistent orientation relative to the ceiling when the storage compartment is in the access position, the storage position and positions between the access and storage positions. The sink is mounted to the frame and the water supply lines extend between the sink and the water supply to provide water to the sink.

According to still another aspect of the disclosure, a storage system for mounting to a ceiling of a structure having an electrical supply is provided. The storage system comprises a mounting frame, a storage compartment, a lift mechanism, a tilt mechanism, and a television. Portions of the mounting frame are disposed above the ceiling. The storage compartment is coupled to the mounting frame for pivotal movement relative to the ceiling between an access position and a storage position. The storage compartment comprises a frame and at least one shelf having a support surface. The shelf is mounted to the frame for pivotal movement relative thereto. The lift mechanism is coupled to the frame of the storage compartment and configured to raise the storage compartment from the access position to the storage position. The tilt mechanism is coupled to the shelf and configured to maintain the support surface of the shelf in a substantially consistent orientation relative to the ceiling when the storage compartment is in the access position, the storage position and positions between the access and storage positions. The television is mounted to the frame and powered by the electrical supply.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

In describing the disclosed storage system, reference is made to the following figures in which.

Corresponding reference characters indicate corresponding parts throughout the several views. Like reference characters tend to indicate like parts throughout the several views.

DETAILED DESCRIPTION

Figure 1:
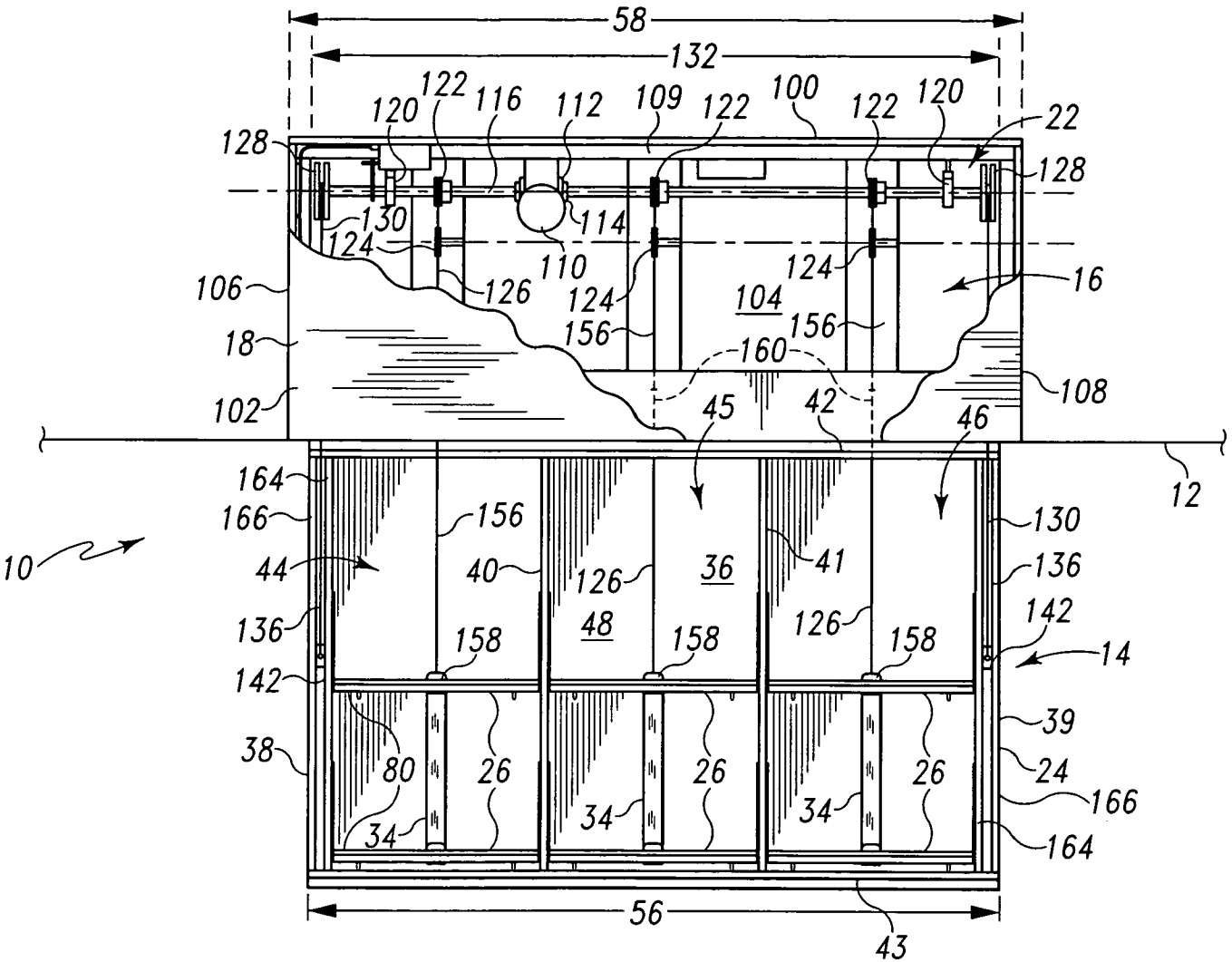
FIG. 1 is a plan view with parts broken away of a first embodiment of a storage system in an access configuration.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The disclosed storage system 10, 810, 1110 utilizes overhead space for storage of items. Various embodiments of the storage system act as a cupboard 10, as shown, for example, in FIGS. 1-7, an entertainment center 1110, as shown, for example, in FIG. 11 and a wet bar 810, as shown, for example, in FIG. 8. Non-illustrated specific embodiments of the storage system 10 act as a gun cabinet, a tool bench, a medical cabinet, a military "foot" locker, and a closet. However, it is within the scope of the disclosure for the storage system to be to be used for storage of other items. Each of the illustrated embodiments 10, 810, 1110 is shown as utilizing attic space between a ceiling 12 and a roof for storage of items. However, it is within the scope of the disclosure for the storage system to be mounted to ceilings or overhead surfaces and not mounted in a recessed manner.

Figure 2:
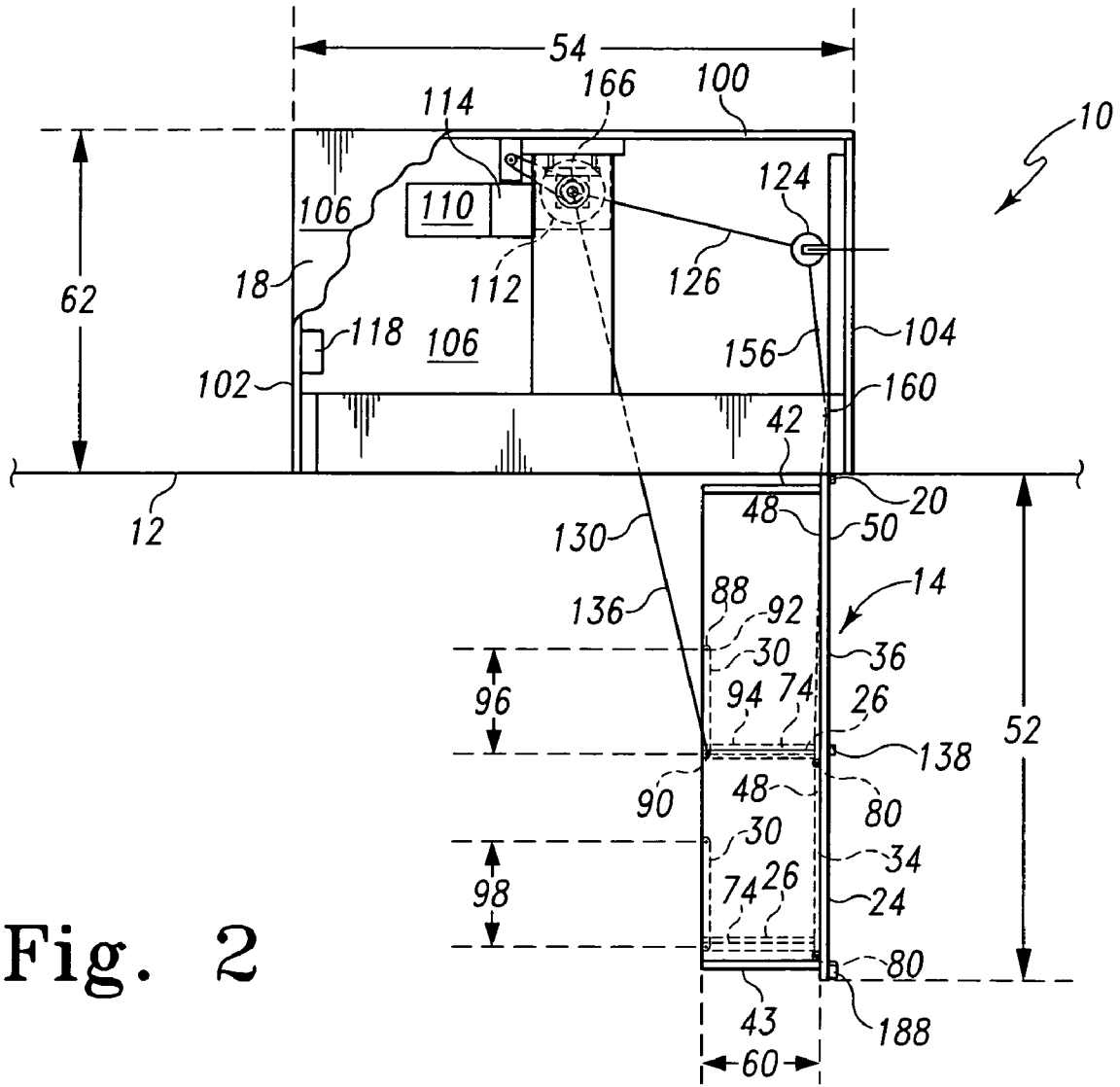
FIG. 2 is a side elevation view with parts broken away of the storage system of FIG. 1 in the access configuration.
Figure 3:
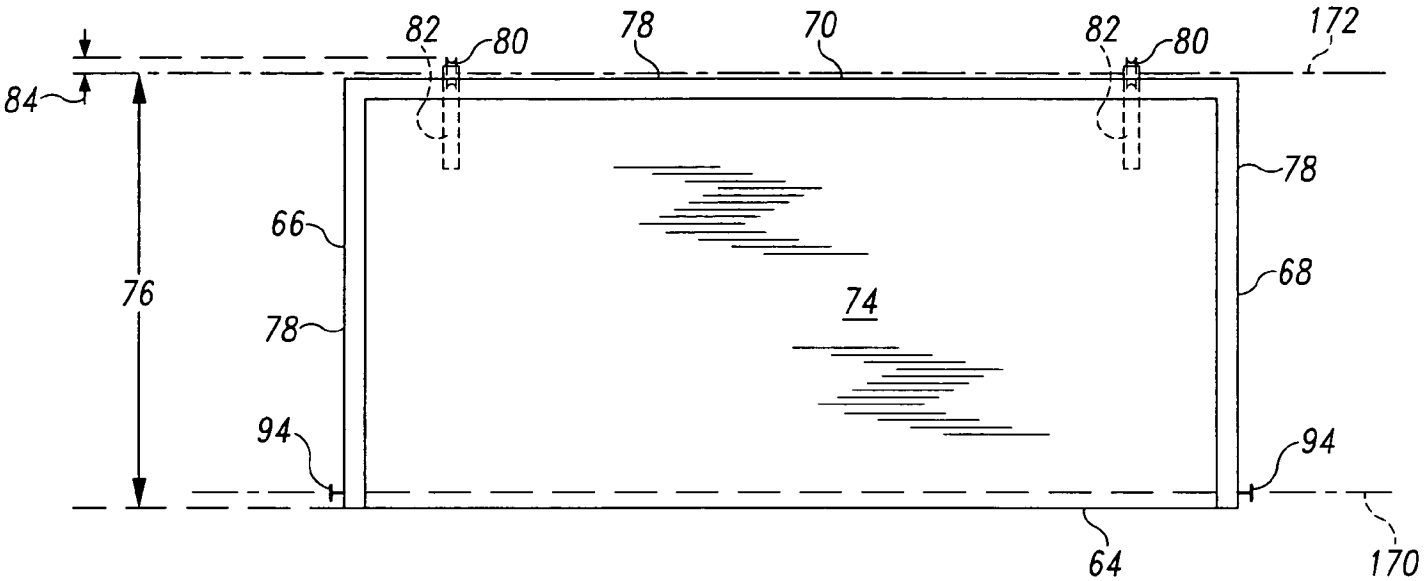
FIG. 3 is a top view of a shelf of the storage system of FIG. 1.
Figure 4:
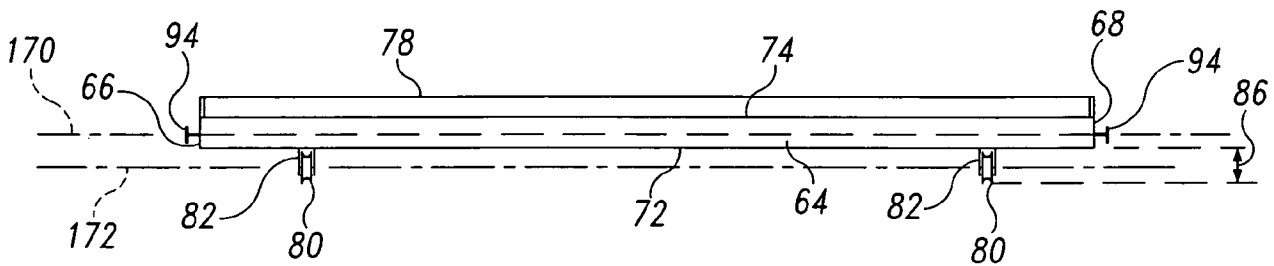
FIG. 4 is a front view of the shelf of FIG. 3.
Figure 5:
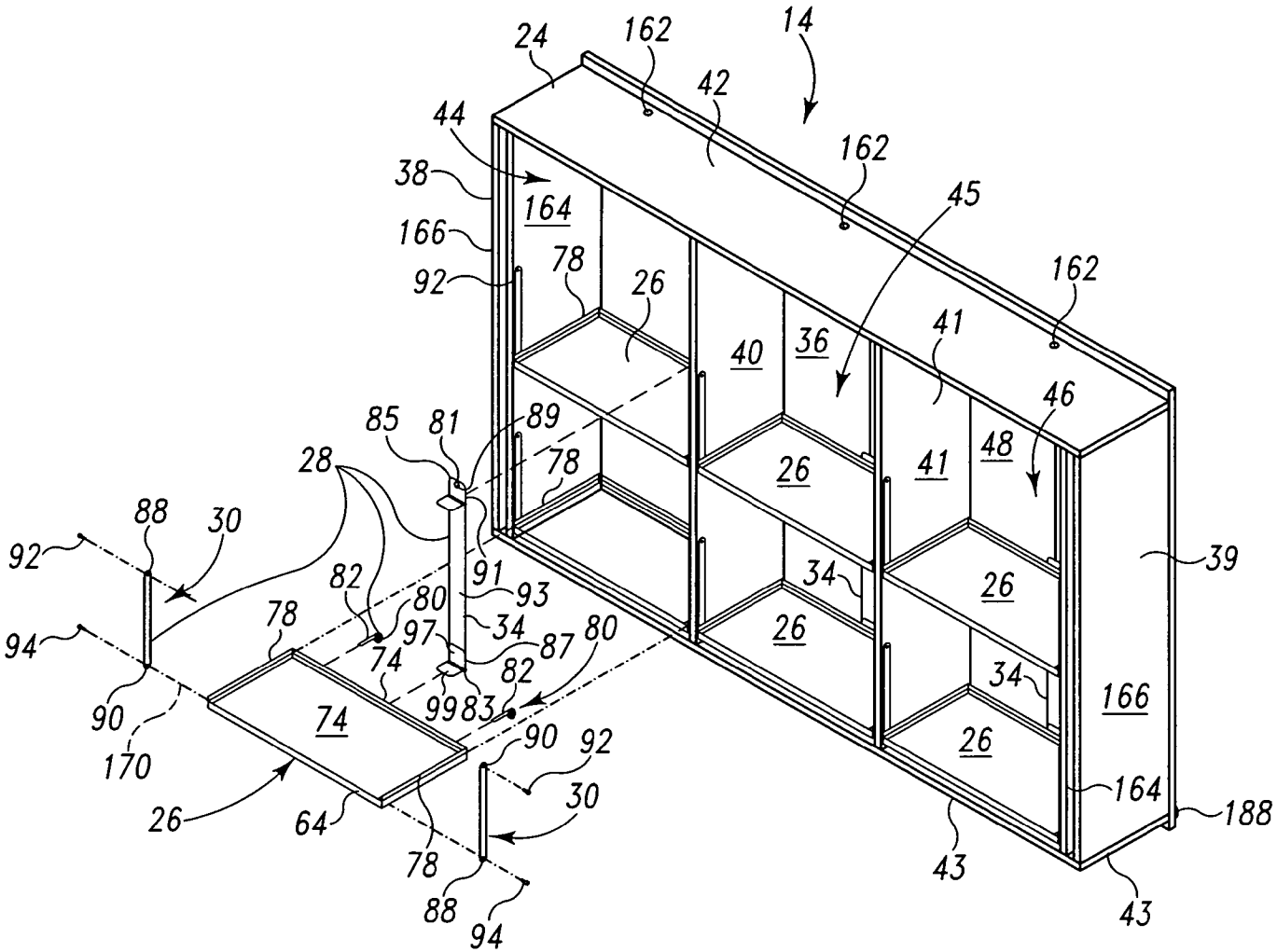
FIG. 5 is a partially exploded view of the storage compartment of the storage system of FIG. 1.
Figure 6:
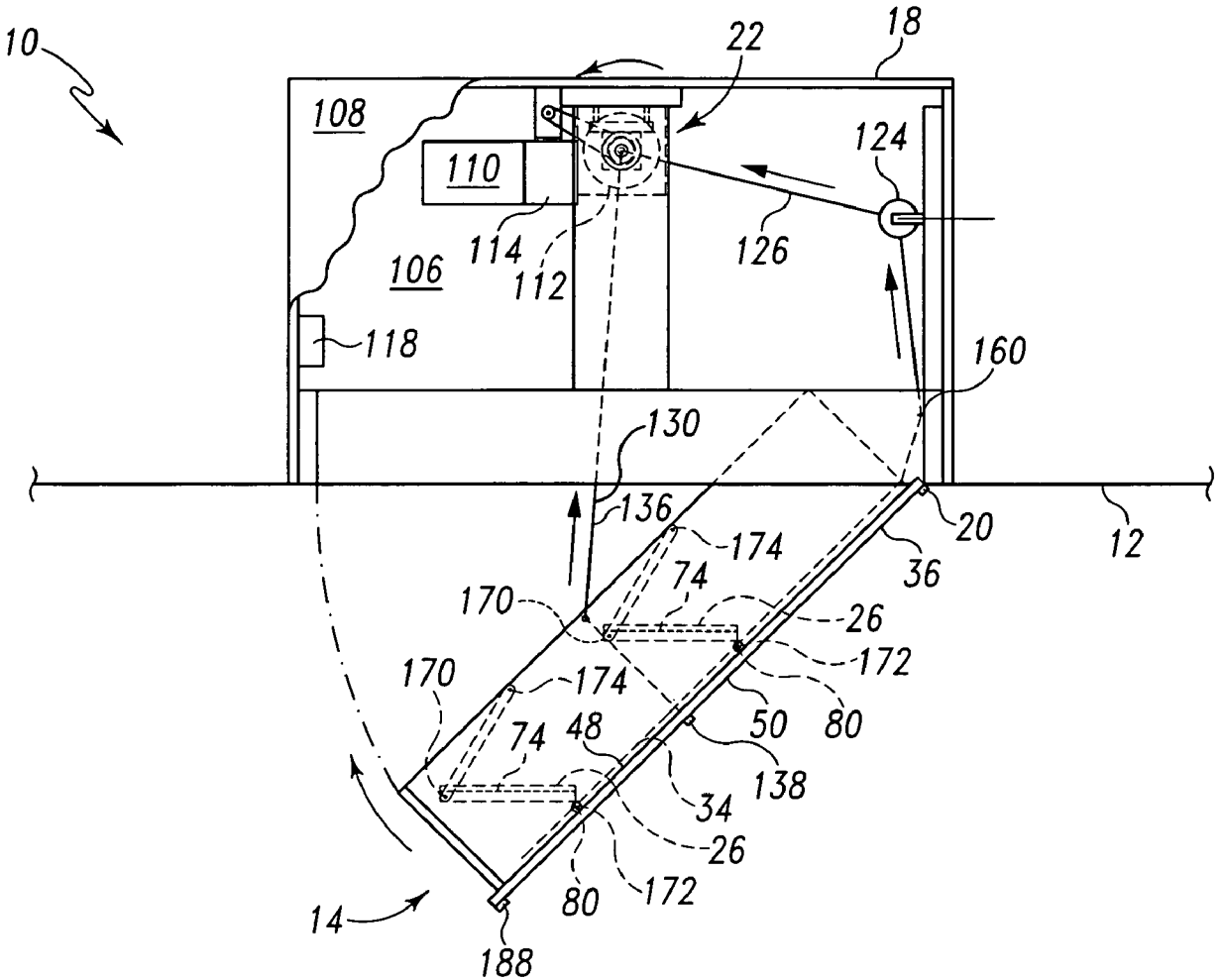
FIG. 6 is a side view with parts broken away of the storage system in a transitional state between the storage configuration and the access configuration shown in FIG. 2.
Figure 7:
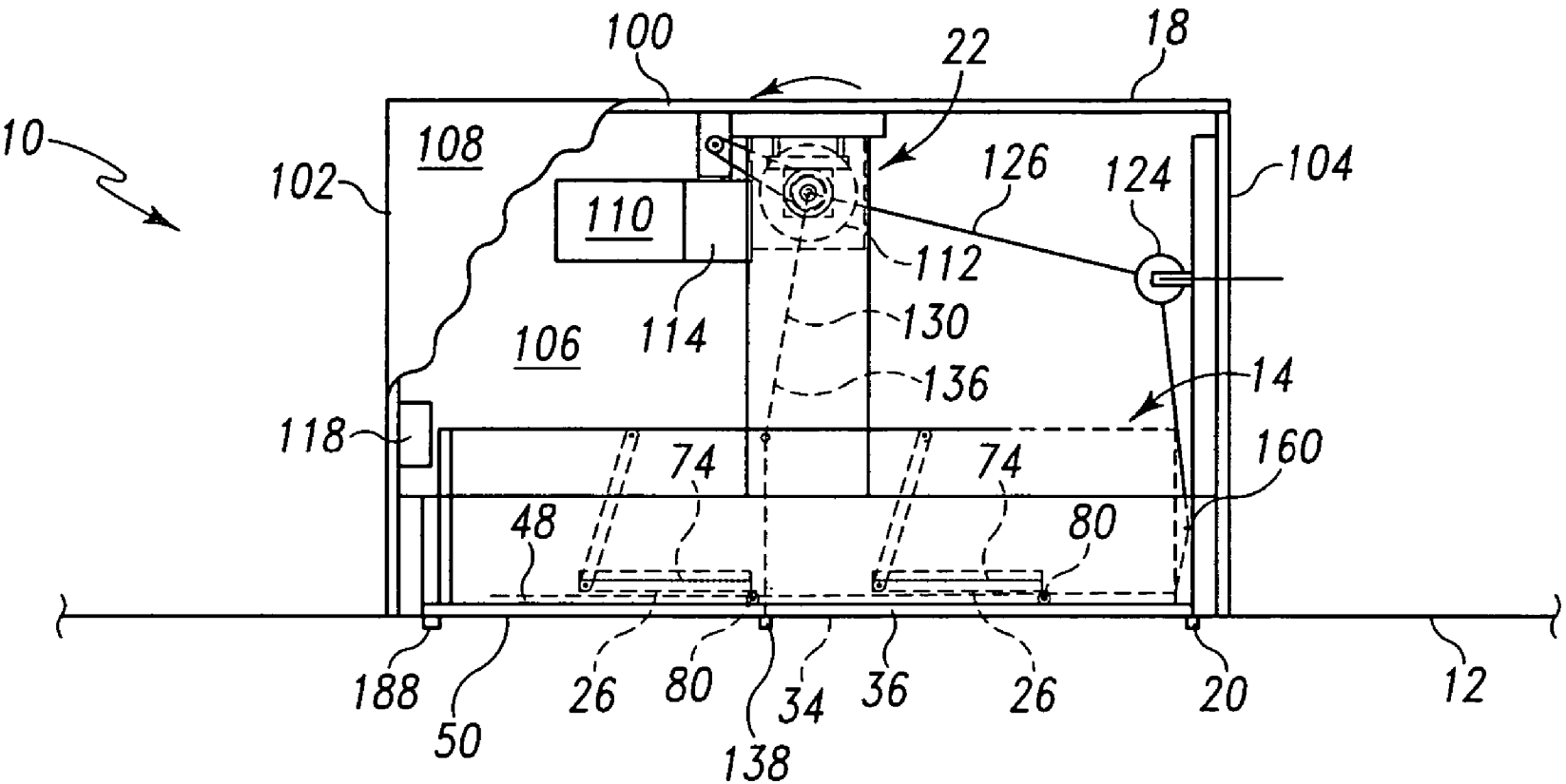
FIG. 7 is a side view with parts broken away of the storage system of FIG. 2 in the storage configuration.
Figure 11:
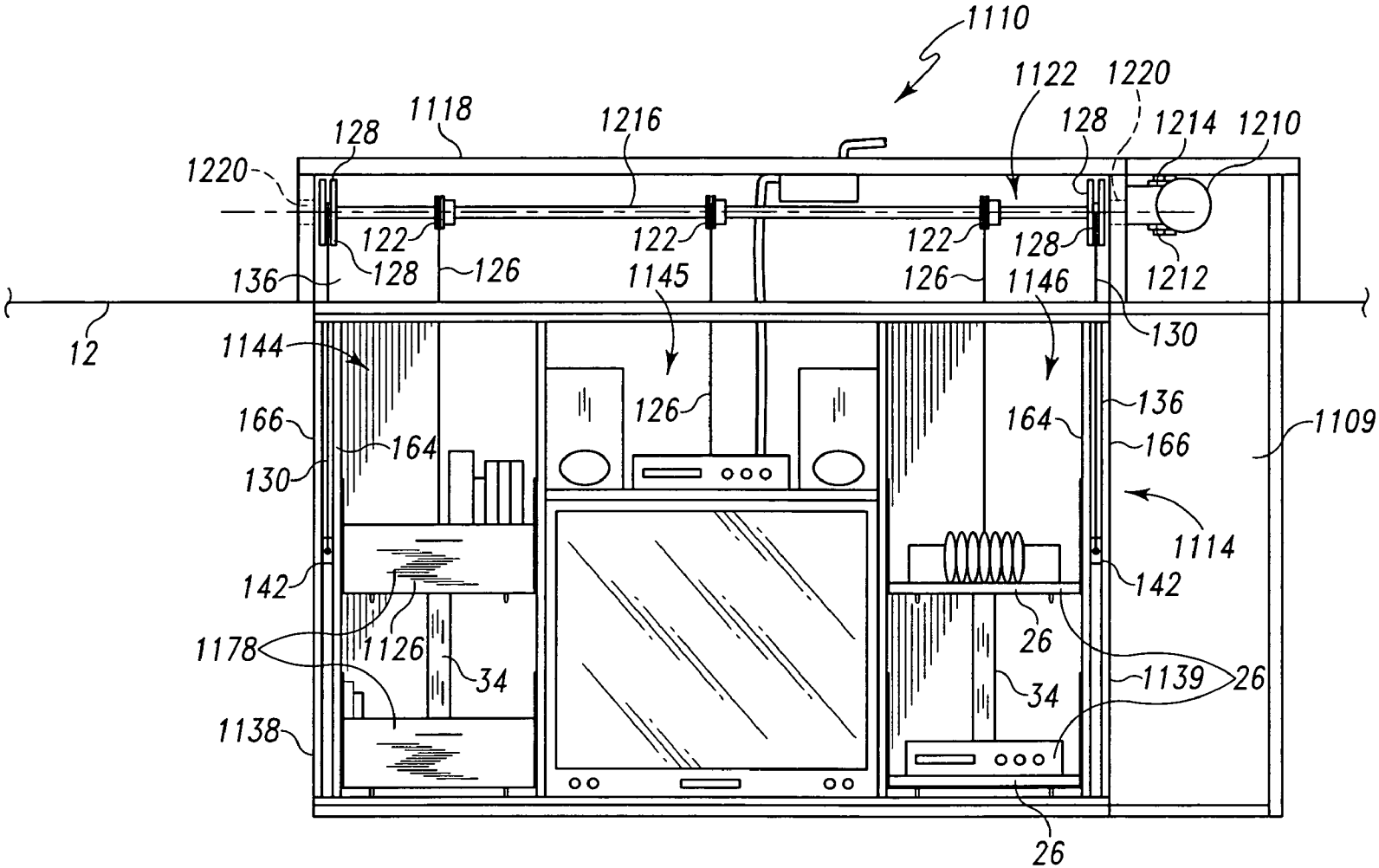
FIG. 11 is a plan view with parts broken away of a third embodiment of a storage system wherein the storage system is configured as an entertainment center wherein the motor, brake and gearbox are mounted outside of the main enclosure.
Figure 12:
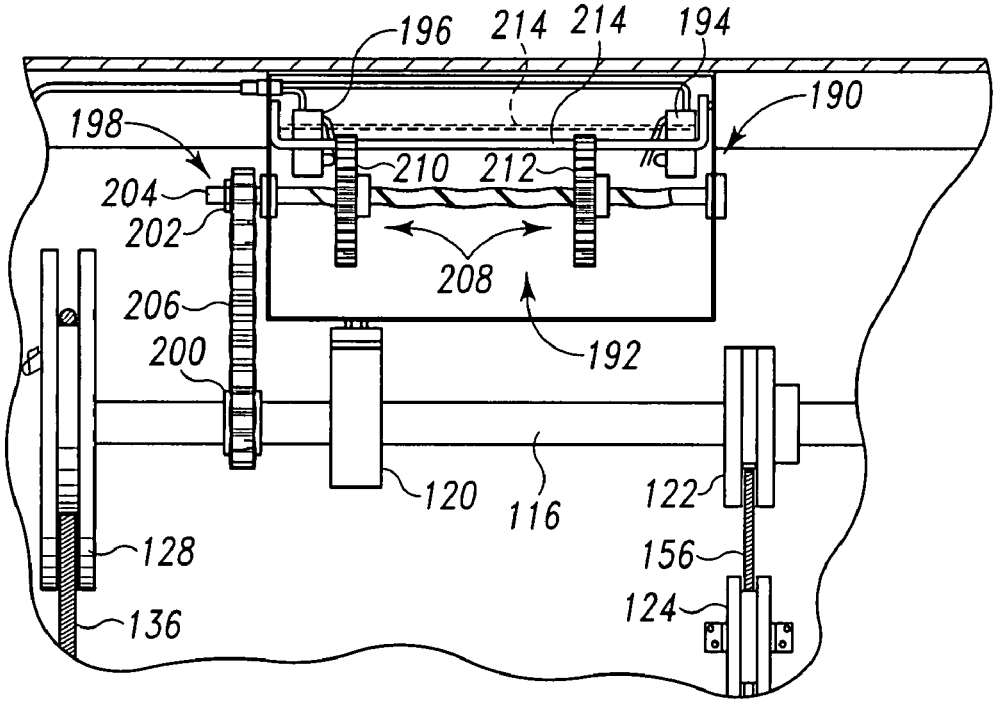
FIG. 12 is a plan view of a portion of the storage system of FIG. 1 with a front cover of a limit mechanism removed shown with the storage compartment in the access position.
Figure 13:
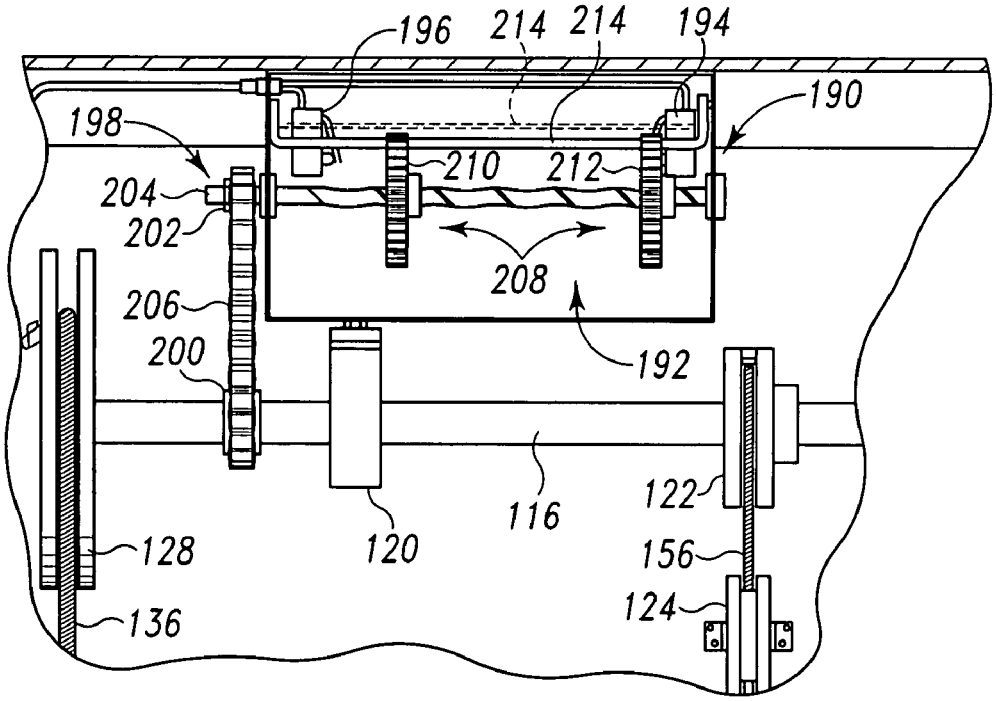
FIG. 13 is a plan view similar to FIG. 12 with the storage system in the storage position.

The storage systems 10, 810, 1110 are configured to include a storage compartment 14 that pivots between a storage position, as shown, for example, in FIG. 7 and an access position, as shown, for example, in FIGS. 1-2, 11. In describing the storage systems 10, 810, 1110 reference will initially hereafter be made to storage system 10 with the understanding that much of the description of storage system 10 is equally applicable to storage systems 810, 1110. After initially describing storage system 10, storage systems 810 and 1110 will be described with a focus toward the different or additional elements included in these embodiments.

In the illustrated embodiments, a downwardly opening cavity 16 is formed by an enclosure 18 positioned above the ceiling 12 of a room. Illustratively, enclosure 18 is insulated to protect the stored materials from temperature extremes present in attic spaces. Those skilled in the art will recognize that the storage system 10 need not include an insulated enclosure 18 or even a separate enclosure. It is also within the scope of the enclosure for duct work from the building's heating and cooling system to be run to the enclosure. It is also within the scope of the disclosure for the storage system 10 to be mounted directly to a ceiling or other overhead structure. While the term "overhead structure" is used herein that term should not be interpreted to require that the structure be positioned at a height above the head of anyone but should be interpreted as being above floor or ground level.

In a first illustrated embodiment, the storage system 10 acts as a kitchen cupboard or pantry as shown, for example, in FIGS. 1-7. Illustratively, storage system 10 includes an enclosure 18, a storage compartment 14, a hinge 20 and a motorized pivot mechanism 22. Storage compartment 14 is coupled by hinge 20 to enclosure 18 for pivotal movement relative to the enclosure 18 between a storage position and an access position. Illustratively, the hinge 20 couples the back wall 36 of the frame 24 of the storage compartment 14 to the back wall 104 of enclosure 18. It is within the scope of the disclosure for the storage compartment 14 to be coupled by a hinge 20 to the ceiling, an overhead structure, or a structural component of the ceiling. Illustratively, hinge 20 is a piano hinge extending substantially along the width 56 of the storage compartment 14. It is within the scope of the disclosure for multiple hinges to be mounted to pivotally couple the storage compartment 14 to the enclosure 18 or ceiling 12.

In the storage position the storage compartment 14 is located substantially within the enclosure 18, as shown, for example, in FIG. 7. In the access position the storage compartment 14 is substantially outside of the enclosure 18, as shown, for example, in FIGS. 1-2, 11. Illustratively, the enclosure 18 is configured to be disposed between two ceiling joists and mounted in a recessed manner relative to the ceiling 12. Those skilled in the art will recognize that mounting the storage system 10 in an existing structure may require removal of portions of some ceiling joists and reinforcement of ceiling components.

In the illustrated embodiment, storage compartment 14 includes a frame 24, a plurality of pivotable shelves 26, and a plurality of pivot hardware 28. In the illustrated embodiment, pivot hardware 28 includes two pivot arms 30 and two guide wheels 80 for each pivotable shelf 26 and a linkage arm 34 coupling pivotable shelves 26 in each compartment to each other and to the motorized pivot mechanism 22. Each pivot arm 30 is coupled to the frame 24 and to a pivotable shelf 26 to facilitate pivotal movement of the shelf 26 relative to the frame 24. It is within the scope of the disclosure for the pivot hardware 28 to include other mechanisms, such as a parallelogram linkage, configured to maintain the support surface substantially horizontal throughout the range of movement of the storage system 10.

In the illustrated embodiment, frame 24 includes a back wall 36, side walls 38, 39, divider walls 40, 41 and end walls 42, 43. Thus, the illustrated storage compartment 14 includes three distinct compartments 44, 45, 46 within which shelves 26 are mounted for movement relative to the frame 24. Those skilled in the art will understand that more or less, including zero, divider walls may be provided in a storage compartment 14 within the scope of the disclosure. Thus, shelves 26 may be mounted to opposite side walls 38, 39, to one side wall and one divider wall, or to two divider walls for pivotal movement relative to the frame within the scope of the disclosure.

In the illustrated embodiment, each side wall 38, 39 extends perpendicularly outwardly from one side of the back wall 36. Each end wall 42, 43 extends perpendicularly outwardly from adjacent an end of the back wall 36 and extends between side walls 38, 39. Each end wall 42, 43 is configured to be perpendicular to each side wall 38, 39. Each divider wall 40, 41 extends perpendicularly between end walls 42, 43 and perpendicularly outwardly from back wall 36. Thus, divider walls 40, 41 are parallel to side walls 38, 39 and perpendicular to end walls 42, 43. Also top end wall 42 is parallel to bottom end wall 43. Opposite side walls 38, 39 are parallel to each other.

Back wall 36 is sized to fit in the opening of downwardly extending cavity 16 formed by enclosure 18. To facilitate pivotal movement of the storage compartment 14 between the storage position and the access position, the bottom end wall 43 is offset upwardly from the bottom end of the back wall 36. This offset is sufficient to allow the storage compartment 14 to pivot into the enclosure 18.

Back wall 36 includes a front surface 48 and a rear surface 50. Front surface 48 acts as the back wall of the storage compartment 14. Illustratively, front surface 48 also acts as a bearing surface against which wheels 80 of shelves 26 ride during pivotal movement of the frame 24 and the shelves 26 relative to the frame 24. In the illustrated embodiment, the back wall 36 has a length 52 approximately equal to the outside length 54 of the enclosure 18 and a width 56 approximately equal to the outside width 58 of the enclosure 18. Thus, when the storage compartment 14 is in the stored position, the back wall 36 of the frame 24 of the storage compartment 14 completely covers the opening of the cavity 16 formed by the enclosure 18.

Alternatively, if air flow into the enclosure 18 is desired, the dimensions 52 and 56 of the back wall 36 of the frame 24 may be slightly smaller than the dimensions 54 and 58 of the opening of the cavity 16 formed by the enclosure 18 so that small gaps are present between the frame 24 and the enclosure 18 for air circulation. The rear surface 50 of the frame 24 of the storage compartment 14 may be painted and/or textured to simulate the ceiling 12 within which the storage system 10 is recess mounted. Preferably the back wall 36 has a thickness sufficient that when the front surface 48 of the back wall 36 engages the bottom of the enclosure 18, the rear surface 50 of the back wall 36 will be flush with the ceiling 12 when the system 10 is recess mounted, as shown, for example, in FIG. 7.

Illustratively, the depth 60 of end walls 42, 43, divider walls 40, 41 and side walls 38, 39 are similar so that a shelf-receiving compartments 44, 45, 46 are formed by back wall 36, side walls 38, 39, divider walls 40, 41 and end walls end walls 42, 43. In the illustrated embodiment, shelf-receiving compartment 44 is formed by back wall 36, side wall 38, divider wall 40 and end walls 42, 43. Similarly, shelf-receiving compartment 45 is formed by back wall 36, divider walls 40, 41 and end walls 42, 43. Also, shelf-receiving compartment 46 is formed by back wall 36, side wall 39, divider walls 41 and end walls 42, 43. The depth 60 of side walls 38, 39, divider walls 40, 41 and end walls 42, 43 is less than the depth 62 of the enclosure 18 so that side walls, 38, 39, divider walls 40, 41 and end walls 42, 43 can be received completely within the cavity 16 formed by enclosure 18 when the storage compartment 14 is in the storage position.

Illustratively, supports are shelves 26 mounted to the frame 24 for pivotal movement relative thereto, however, it is within the scope of the disclosure for supports to include drawers, boxes and other structures having a supporting surface on which objects rest. Each shelf 26 includes a front wall 64, two side walls 66, 68, a rear wall 70, a bottom surface 72 and a support surface 74, as shown, for example, in FIGS. 3 and 4. In the illustrated embodiment, adjacent the front wall 64 each shelf 26 is mounted to a pivot arm 30 which is mounted to the side wall 38, 39 or a divider wall 30, 41 of a storage compartment 44, 45, 46. Illustratively, shelf 26 has a depth 76 less than the depth 60 of side walls 38, 39. In one specific embodiment the depth 76 of shelf is 10.5 inches while the depth 60 of side walls is 11.0 inches. Those skilled in the art will recognize that the dimensions provided herein with regard to a specific embodiment may be modified within the scope of the disclosure to facilitate different size storage compartments 14 and motorized pivot mechanisms 22.

Illustratively, the shelves 26 are mounted so that the support surface 74 of the shelf 26 remains substantially horizontal regardless of whether the storage compartment 14 is in the storage position, the access position or any position therebetween. In the illustrated embodiment, the front surface 48 of the back wall 36 of the frame 24 of the storage compartment 14 is substantially vertical when the storage compartment 14 is in the access position. Thus, when the storage compartment 14 is in the access position, the support surface 74 of the shelf 26 is substantially perpendicular to the back wall 36 of the frame 24 of the storage compartment 14. In the illustrated embodiment the back wall 36 of the frame 24 of the storage compartment 14 is substantially horizontal when the storage compartment 14 is in the storage position. Thus, when the storage compartment 14 in the storage position, the support surface 74 of the shelf 26 is substantially parallel to the back wall 36 of the frame 24 of the storage compartment 14.

Illustratively, each pivoting shelf 26 includes retainer walls 78 extending perpendicularly from the support surface 74 to retain items on the support surface 74 during pivotal movement of the shelf 26 relative to the frame 24. In the embodiment illustrated in FIGS. 1-7, the retainer walls 78 are small angled brackets mounted to the support surface 74 adjacent the side walls 66, 68 and rear wall 70 and extending upwardly approximately 0.5 inches from the support surface. It is within the scope of the disclosure for a retainer wall 78 to be provided adjacent the front wall 64 of the shelf 26 in addition to the illustrated retainer walls or for the shelf 26 to be provided with fewer, including zero, retainer walls 78. It is also within the scope of the disclosure for the retainer walls 78 to be formed from other materials or integrally formed as part of a monolithic shelf 26. Also, as suggested by FIG. 11 hereafter, retainer walls 78 may be substantially taller than illustrated in FIGS. 1-7.

Illustratively, each shelf includes a plurality of guide wheels 80 mounted with brackets 82 to the bottom surface 72 of the shelf 26. In the illustrated embodiment, the each guide wheel 80 extends rearwardly beyond the rear wall 70 of the shelf 26 and extends downwardly beyond the bottom surface 72 of the shelf 26. Thus, wheels 80 are positioned to engage the back wall 48 of the frame 24 of the storage compartment 14 during pivotal movement of the shelf 26 relative to the frame 24. Wheels 80 act as bearings providing for smooth movement of the shelf 26 relative to the frame 18 by reducing friction between the two components. Illustratively, wheels 80 extend rearwardly beyond the rear wall 70 of the shelf 26 by a distance 84. In one specific embodiment distance 84 is 0.5 inches which provides the shelf with an effective depth, i.e. shelf depth 76 plus distance 84, of 11.0 inches equal to the depth 60 of walls 38-43 of frame 24. Also wheels extend downwardly from bottom surface 72 of shelf 26 by a distance 86. In one specific embodiment, the distance 86 is 1.0 inches.

Illustratively, each pivot arm 30 includes a frame end 88 and a shelf end 90. Each pivot arm 30 is coupled at frame end 88 for pivotal movement about a pivot pin 92 extending through pivot arm 30 and frame 24. Each pivot arm 30 is coupled at shelf end 90 for pivotal movement about a pivot pin 94 extending through pivot arm 30 and a pivotable shelf 26. Illustratively, the moment arm 96 between the shelf pivot point (where pivot pin 94 extends through shelf end 90 of pivot arm 30) and the frame pivot point (where pivot pin 92 extends through frame end 88 of pivot arm 30) is 9.875 inches. As shown, for example, in FIG. 2, the distance pivot pin 92 is offset from the front of storage compartment 14 is the same as the distance pivot pin 94 is offset from the front wall 64 of the shelf 26. The length 98, the moment arm 96 and the mounting location of the pivot arm 30 to the frame 24 and shelf 26 are such that the shelf 26 can remain substantially horizontal when rotating between the storage position and access position without the pivot arm 30 engaging the back wall 48 of the frame and inhibiting movement of the shelf 26.

The pivot arm 30 is pivotally mounted at its frame end 88 to a side wall or divider wall of the frame 24 of the storage compartment 14. In the illustrated embodiment, each pivot arm 30 is an identical length 98 and has an identical effective moment arm 96. The moment arm 96 of each pivot arm 30 is less than the depth 60 of the walls 38-43 of the storage compartment 14. The pivot arm 30 extends parallel to the back wall 36 of the storage compartment 14 when the storage compartment 14 is in the access position.

Shelf 26 pivots about three pivot axes 170, 172, 174 with respect to the frame 24 of the storage compartment 14. The first pivot axis 170 extends parallel to the front of the shelf 26 and through the shelf end 90 of each pivot arm 30. Screws or rivets acting as pivot pins 94 extending through holes in the shelf end 90 of each pivot arm 30 and into the side walls 66, 68 of each shelf 26 define first pivot axis 170. The second pivot axis 172 about which each shelf 26 pivots extends parallel to the rear wall 70 of the shelf 26 and extends through the axles of the wheels 80. The first pivot axis 170 is itself pivotable with respect to the frame 24 about the third pivot axis 174 extending through the frame end 88 of the pivot arm 30. Screws or rivets acting as a pivot pins 92 extending through holes formed in the frame ends 88 of each pivot arm and into either a side wall 38, 39 or a divider wall 40, 41 act to define third pivot axis 174. Thus, third pivot axis is fixed relative to the frame 24 of the storage compartment 14. Since in the illustrated embodiment, the wheels 80 always engage back wall 36 of frame 24, second pivot axis 174 is arranged for longitudinal movement with respect to the frame 24. Illustratively, second pivot axis moves longitudinally parallel to the back wall 36 of the frame 24.

The linkage arm 34 includes an upper end 81, a lower end 83, an upper shelf mounting hinge 85 and a lower shelf mounting hinge 87. Upper end 81 is formed to include a connector 89 for coupling to the shelf cable 156 of the motorized pivot mechanism 22. The upper mounting hinge 85 includes a plate 91 mounted to the body 93 of the linkage arm 34 and a plate 95 configured for mounting to the bottom surface 72 of an upper pivoting shelf 26. The lower mounting hinge 87 includes a plate 97 mounted to the body 93 of the linkage arm 34 and a plate 99 configured for mounting to the bottom surface 72 of a lower pivoting shelf 26 in a compartment 44, 45, 46. In the illustrated embodiment, since two pivoting shelves 26 are shown in each compartment 44, 45, 46, three separate linkage arms 34 are disclosed, one for each compartment 44, 45, 46. Upper mounting hinge 85 and lower mounting hinge 87 are mounted to the body 93 of linkage arm 34 at positions wherein they maintain the desired separation between the pivoting shelves 26. The linkage arm 34 allows a single shelf cable to initiate rotation of two shelves 26 within a single compartment 44, 45, 46.

In the illustrated embodiment, enclosure 18 includes a top wall 100, a front wall 102, a rear wall 104, a first side wall 106 and a second side wall 108. Top wall 100, front wall 102, rear wall 104 and side walls 106, 108 are joined to form a downwardly opening cavity 16. Illustratively, cavity 16 is sized to receive storage compartment 14 substantially therein.

In the illustrated embodiment, each side wall 106, 108 extends perpendicularly downwardly from one side of the top wall 100. The front wall 102 extends perpendicularly from the front of top wall 100 and extends between side walls 106, 108. Front wall 102 is configured to be perpendicular to each side wall 106, 108. The rear wall 104 extends perpendicularly from the rear of top wall 100 and extends between side walls 106, 108. Rear wall 104 is configured to be perpendicular to each side wall 106, 108. Thus, front wall 102 is parallel to rear wall 104, and opposite side walls 106, 108 are parallel to each other.

In the illustrated embodiment, motorized pivot mechanism 22 includes a motor 110, a gearbox 112, a brake 114, a drive shaft 116, controller 118, a plurality of suspended bearings 120, a plurality of shelf cable pulleys 122, a plurality of shelf cable drive pulleys 124, a plurality of shelf couplings 126, a plurality of lift pulleys 128 and a plurality of lift couplings 130. As shown, for example, in FIGS. 1-2, in the cupboard embodiment of storage system 10, the motor 110, gearbox 112, and brake 114 and suspended bearings 120 are mounted to a frame member 109 running along the top wall 100 of the enclosure 18 to allow drive shaft 116 to extend through the suspended bearings 120 and gearbox 112. The motor 110 and gearbox 112 are coupled to the shaft 116 to drive the shaft 116 to rotate about its longitudinal axis. Illustratively, motor 110 is a ¾ Horsepower, 1800 R.P.M., reversible, 110V, line 56, C-flange open, drop proof motor available from LEESON Electric Corporation, PO Box 241, Grafton, Wis. 53024 as Catalog No. Pro 30074. To facilitate coupling motor 110 to brake 114 and gearbox 112, the C-flange face provided with the motor is replaced with a D-flange face. D-faces are designed to mount directly to equipment with a matching configuration. They feature a machined flange on the shaft end with four through holes and a raised rabbet. Gearbox 112 is a Leeson IronMan by Ohio Gear™ gear reducer available from LEESON Electric Corporation, PO Box 241, Grafton, Wis. 53024, as Model No. HMQ 82460-56-H. Gearbox 112 illustratively has a 60:1 ratio.

It is within the scope of the disclosure for motorized pivot mechanism 22 to include actuators other than a motor 110 configured to pivot the storage compartment between the storage and access positions. Such alternative actuators include hydraulic actuators, electromagnetic actuators, pneumatic actuators and the like. Those skilled in the art will recognize that the disclosed pivot mechanism can be adapted by incorporating gears between the shaft of a linear actuator to translate linear movement of the actuator into rotational movement of the drive shaft 116. Additionally, alternative pivot mechanisms can be implemented to translate actuator movement into pivotal movement of the storage compartment and the pivotable shelves 26 contained therein.

Illustratively, motor 110 has a detent force. Thus, when the motor 110 is coupled to gearbox 112, sixty times the detent force of the motor 110 must be exerted to induce the storage compartment 14 to lower. In the event of power failure the disclosed motor 110 and gearbox 112 act to prevent storage compartment from inadvertently pivoting toward the access position. Additional safety features are provided by the brake 114. The brake 114 is an electrically driven friction disk brake that engages when no power is present on the leads of the motor 110 and disengages when power is present at the leads of the motor 110. The brake 114 acts as a safety device in the event of power failure to prevent the storage compartment from inadvertently lowering. The brake 114 also inhibits the storage compartment 14 from moving from its desired location anytime the motor 110 is stopped, e.g. when the storage compartment 14 has reached the access position or the storage position or anytime a user has selectively stopped the motor Drive shaft 116 is received in the plurality of bearings 120 mounted to the enclosure 18. As shown, for example, in FIG. 1, storage system 10 includes 2 suspended bearings 120 each mounted to the top surface 100 of the enclosure 18 adjacent a side wall 106, 108. The suspended bearings 120 are configured to facilitate rotation of drive shaft 116 about its longitudinal axis when driven by motor 110 and gear box 112. While shown as being mounted to the inside top wall 100 enclosure 18, it is within the scope of the disclosure for motor 110, gearbox 112, drive shaft 116 and bearings 120 to be mounted to some other frame component of the storage system 10 or to be mounted directly to the structure in which the storage system 10 is mounted.

Illustratively, drive shaft 116 has a length 132 approximately equal to the width 134 of the storage compartment 14. In the illustrated embodiment, the plurality of lift pulleys 128 comprises two lift pulleys 128. One lift pulley 128 is mounted adjacent each end of the drive shaft 116. As shown, for example, in FIG. 1, each lift pulley 128 is mounted to the drive shaft 116 to be aligned with the center of a side wall 38, 39 of the storage compartment 14. In the illustrated embodiments, the plurality of lift couplings 130 includes a plurality of lift cable 136. Illustratively, the plurality of lift cables 136 includes two lift cables 136.

As shown, for example, in FIGS. 1-2, 7-8, a lift cable 136 is mounted to each lift pulley 128 to be wound thereabout during rotation of the drive shaft 116. A distal end 138 of the lift cable 136 is mounted to the frame 24 of the storage compartment 14 to pull the storage compartment 14 upwardly as the cable 136 is wound about the lift pulley 128. While the illustrated embodiment shows two lift pulleys 128 and associated cables 136, it is within the scope of the disclosure for fewer or more lift pulleys 128 and cables 136 to be provided to facilitate pivoting the storage compartment 14 between the storage and access positions.

In the embodiments illustrated in FIGS. 1-11, each lift cable 136 extends through a lumen 140 in a front block 142 extending between walls of double walled side walls 38, 39 near the front of each side wall 38, 39. Also, each lift cable 136 extends through a lumen 144 in a rear block 146 extending between walls of double walled side walls 38, 39 near the rear wall 36 of the storage compartment 14 and through a hole 148 formed through the rear wall 36. A threaded shaft 150 is crimped to the distal end 138 of the lift cable 136. A washer 152 and nut 154 tightened onto threaded shaft 150, releasably secures the lift cable 136 to the frame 24 of the storage compartment 14. The lumen 140 in front block 142 and the lumen 144 in rear block 146 are illustratively located about 21.118 inches from the bottom edge of the back wall 36 of the storage compartment 14. The positioning of the front cable block 142 helps to eliminate a pinch point between the side wall 38, 39 and the lift cable 136.

In a specific embodiment of the storage system 10, each lift pulley 128 is a six inch diameter molded plastic pulley having a 3.72 diameter hub available from Fenner Drives, 311 W. Stiegel Street, Manheim, Pa. 17545-0101. Each lift cable 136 is a ⅛ inch steel cable which may be plastic-coated if desired. The size of the cable 136 is primarily selected to provide sufficient strength to support the storage compartment 14 when the maximum anticipated load is contained therein. The size of the lift pulley 128 and lift cable 136 are also selected in conjunction with the size of the shelf cable pulley 122 and shelf cable 156 to facilitate maintenance of the support surface of shelves 26 in a substantially horizontal orientation throughout the range of motion of the storage compartment 14.

In the illustrated embodiment, the plurality of shelf cable pulleys 122, the plurality of shelf cable drive pulleys 124 and the plurality of shelf couplings 126 include three shelf cable pulleys 122, three shelf cable drive pulleys 124 and three shelf couplings 126, respectively. Illustratively, each shelf coupling 126 is a shelf cable 156. A shelf cable 156, shelf cable drive pulley 124 and shelf cable pulley 122 are illustratively provided for each compartment 44, 45, 46 of the storage compartment within which rotatable shelves 26 are mounted.

Illustratively, each shelf cable pulley 122 is mounted to the drive shaft 116 in a position that centers the shelf cable pulley 122 over its associated compartment 44, 45, 46 in the storage compartment 14. Shelf cable pulley 122 is fixed to drive shaft 116 so that rotation of the drive shaft induces rotation of shelf cable pulley 122. A proximal end of a shelf cable 156 is mounted to shelf cable pulley 122 to be wound thereabout during rotation of the drive shaft 116.

In a specific embodiment of the storage system 10, each shelf cable pulley 122 is a three inch diameter molded plastic pulley having a 1.82 diameter hub available from Fenner Drives, 311 W. Stiegel Street, Manheim, Pa. 17545-0101. Each lift cable 136 is a 1/16 inch steel cable which may be plastic-coated if desired. The size of the cable 156 is primarily selected to provide sufficient strength to support the shelves 26 when bearing a maximum anticipated load. The size of the shelf pulley 122 and shelf cable 156 are also selected in conjunction with the size of the lift pulley 128 and lift cable 136 to facilitate maintenance of the support surface of shelves 26 in a substantially horizontal orientation throughout the range of motion of the storage compartment 14.

The shelf cable 156 is mounted at the proximal end to the shelf cable pulley 122 and at distal end 158 to the top of the linkage arm 34. Illustratively each shelf cable 156 extends around a shelf cable drive pulley 124 mounted to the back wall 104 of the enclosure 18 or frame, through a guide 160 mounted to the back wall 104 near the bottom of the enclosure 18 or frame, and through a guide hole 162 formed in the center of the top end wall 42 adjacent the back wall 36 of the frame 24 of the storage compartment 14. Illustratively, guide 60 is an eyebolt having an eye sized for the cable to ride therethrough. In the illustrated storage system 10 three shelf cable guide pulleys 124, three guides 160 and three guide holes 162 are provided, one for each compartment 44, 45, 46 within which there are shelves 26 mounted for rotation.

Each shelf cable drive pulley 124 and guide 60 are mounted to the enclosure 18 to align the cable pulley 122 with the linkage arm 34 in its associated compartment 44, 45, 46. Each guide hole is positioned to align the cable pulley 122 with the linkage arm 34 in its associated compartment 44, 45, 46. In a selected embodiment, the eye of each guide 160 is displaced from the back wall 104 of the enclosure by 0.25 inches. In the same selected embodiment, the center of each guide hole 162 is formed in the top end wall 42 of the frame 18 of the storage compartment and is displaced from the back wall 36 of the storage compartment 14 by 0.25 inches. The location of the center of the eye of the guide 160 and the center of the guide hole 162 helps to maintain the body of the linkage arm substantially parallel to the back wall 36 of the frame and at a fairly constant displacement therefrom throughout the range of motion of the storage compartment 14. Thus, the guides 160 and guide holes 162 help to maintain the wheels 80 of the shelves 26 in engagement with the back wall 36 of the frame 24.

As mentioned above, in the illustrated embodiment, each side wall 38, 39 is formed from a double walled construction having an inner wall 164 and an outer wall 166 displaced from the inner wall 164 to facilitate utilization of a release mechanism 168 permitting manual lowering of the storage compartment 14. Illustratively the displacement between the inner wall 164 and outer wall 166 is sufficient to permit the lift cable 136 to extend between the inner wall 164 and the outer wall 166. In one illustrated embodiment, as shown, for example, in FIGS. 9 and 10, a plurality of blocks 142, 146 extend between the inner wall 164 and outer wall 166 to couple the inner and outer side walls 164, 166 together and to maintain the displacement between the inner and outer side walls 164, 166. In the embodiment illustrated in FIGS. 9 and 10, lumens 140, 144 are formed through front block 142 and rear block 144, respectively, in each side wall 38, 39 so that the lift cable 136 passes through the lumens 140, 144. Each lift cable 136 is formed with a threaded end 150 coupled thereto. The threaded end 150 extends through the lumen 144 in the rear block 146 and a hole 148 formed in the back wall 36 of the frame 24. Illustratively, a washer 152 and a nut 154 are attached to each threaded shaft 150 to releasably secure the lift cable 136 to the frame 24 of the storage compartment 14. While in the illustrated embodiment, the end of the threaded shaft 150 attached to the lift cable 136, the washer 152 and the nut 154 are exposed on the rear surface 50 of the back wall 36 of the frame 24 of the storage compartment 14, it is within the scope of the disclosure for the back wall 36 to be formed with an appropriate counter bore and cap to conceal the quick-release mechanism 168.

Those skilled in the art will recognize that the storage system including a quick release mechanism 168 may replace the front block 142 with the cable pin extending laterally between wall 164, 166 and/or eliminate the rear block 144. It is within the scope of the disclosure for the storage system 10 to include other quick release mechanisms such as solid side walls with a cable lumen extending completely therethrough and out a hole in the back wall of the frame. Also, it is within the scope of the disclosure for the lift cable 136 to be mounted to the frame 24 of the storage compartment 14 with cable mountings that are releasable through appropriately configured access panels or holes. It is also within the scope of the disclosure for the lift cable 136 to be more permanently mounted to the storage compartment 14 thereby eliminating the quick release mechanism 168.

Illustratively, a remote control unit 180 communicates with controller 118 and acts to initiate operation of the motor 110 to remotely raise and lower the storage compartment 14. As shown, for example, in FIG. 14, remote control unit 180 includes a transmitter 182 and a receiver 184. In one embodiment, remote transmitter 182 is a push button unit capable of transmitting up, down and stop commands by depressing buttons. In the illustrated embodiment, remote transmitter 182 transmits commands using infrared signals that are received by the infrared receiver 184 coupled to the programmable controller 118.

Illustratively, a wall panel 186 may be mounted to control motor operation. This panel 186 may be wired or wireless. While described as operating on infrared control signals, it is within the scope of the disclosure for wireless communication from either the remote transmitter 182 or the wall panel 186 to the programmable controller 118 to occur via an electromagnetic spectrum transmitter and receiver, such as radio or microwave transmission, ultrasonic transmitter and receiver, or other transceiver system.

Illustratively, rear wall 36 of the frame 24 of the storage compartment 14 includes a touch bar 188 mounted adjacent the bottom end of wall 36. The receipt of a signal from touch bar 188 initiates a reverse sequence causing controller 118 to reverse the direction of the motor 110. It is within the scope of the disclosure for controller 118 to stop the motor 110 upon receipt of a signal from the touch bar 188. Thus, if the rear wall 36 of the frame 24 of the storage compartment 14 comes into contact with a person or object during the process of lowering, the movement of storage compartment 14 is stopped or reversed to prevent injury or damage. Similarly, movement of the storage compartment 14 may be stopped if it engages a person or object during the process of raising the storage compartment 14. Touch bar 188 keeps anyone from being able to hang onto storage compartment 14 during movement.

Touch bar 188 is available from Tapeswitch Corporation, 100 Schmitt Boulevard Farmingdale, N.Y. 11735, as a Controflex Ribbon Switch™. A sensor is present in each end of the touch bar 188 so that no matter where the bar hits on object, the sensor will be actuated and the motor 110 either stopped or reversed. While shown as mounted on the bottom edge of the storage compartment 14, it is within the scope of the disclosure to mount stop bars anywhere on the storage compartment 14 that may come into engagement with foreign objects. In the preferred illustrated embodiment, the stop bar 118 is coupled to the controller 118 and induces a change in direction of the motor 110 when actuated.

As shown, for example, in FIGS. 1-3, 12, 13, storage system 10 includes a position limiter 190. Position limiter 190 is coupled to controller 118 and provides an indication that the storage compartment 14 has reached the storage position and an indication that the storage compartment 14 is in the access position. In the illustrated embodiment, position limiter 190 includes a portion of the control system and a position indicator 192 for determining when the storage compartment 14 has reached a limit in its range of movement. In the illustrated storage system 10, one limit is the access position wherein the back wall 36 of the storage compartment 14 is substantially vertical or perpendicular to the floor and the ceiling 12 and the other limit is the storage position wherein the back wall 36 of the storage compartment 14 is substantially horizontal or parallel to the floor and the ceiling 12.

In the illustrated embodiment, position indicator 192 includes an upper limit indicator 194, a lower limit indicator 196 and a coupler 198 between the storage compartment 14 and the upper and lower limit indicators 194, 196. The coupler 198 is configured to actuate the upper limit indicator 194 when the storage compartment 14 is in the storage position and to actuate the lower limit indicator 196 when the storage compartment 14 is in the access position. In the illustrated embodiment, coupler 198 includes a first sprocket 200 coupled to the drive shaft that turns the lift pulleys around which the lift cables wrap, a second sprocket 202 attached to a threaded shaft 204, a chain 206 coupling the first sprocket 200 and second sprocket 202, and a threaded actuator 208 configured to move longitudinally along the threaded shaft 204 during shaft rotation.

In the illustrated embodiment, the threaded actuator 208 includes an upper limit actuator gear 210 and a lower limit actuator gear 212. Each actuator gear 210, 212 is mounted on the threaded shaft 204 and includes internal threading that conforms to the thread pattern of the shaft 204. Each actuator gear 210, 212 is configured so that if the actuator gear 210, 212 is prevented from rotating, rotation of the shaft 204 will induce the actuator gear 210, 212 to move along the longitudinal axis of the shaft 204. Thus rotation of the shaft 204 is translated into longitudinal movement of the actuator gear 210, 212. A stop 214 is configured to selectively be disposed between adjacent teeth of each actuator gear 210, 212 to prevent rotation of the actuator gear 210, 212 and in a non-interfering position (shown in phantom lines in FIGS. 12, 13) wherein rotation of the gear 210, 212 is not inhibited. When the stop 214 is disposed in the non-interfering position, each gear 210, 212 can be rotated with respect to the stationary shaft 204 to facilitate calibrating the position indicator 190 to properly indicate when the storage compartment 14 is in the storage position and the access position.

While the illustrated embodiment of the position indicator 192 includes an upper and lower limit indicator 194, 196 implemented using limit switches positioned to be engaged by the threaded actuator 208, it is within the scope of the disclosure for the position indicator 192 to include sensors and feedback capable of indicating the position of the storage compartment 14 throughout its range of motion. Therefore, it is within the scope of the disclosure for position indicator 192 to include a sensor receiving reflected return signals from the storage compartment 14 so that distance can be calculated as a function of signal transit time. It is also within the scope of the disclosure for optical encoders, hall sensors or other sensors to be mounted to the shaft of the motor or gearbox or the drive shaft to provide positional feedback. Also, limit switches or proximity sensors may be configured to be actuated when the storage compartment 14 reaches specific positions in its range of motion.

The control box includes the controller 118 for the storage system. Illustratively controller 118 includes a programmable controller such as a Moeller Easy 416 available from Indy Control, Beech Grove, Ind. Those skilled in the art will recognize that controller 118 can be implemented in other manners, including but not limited to, using a micro-processor, discrete logic gates, integrated circuits, and discrete components. The illustrated controller 118 controls the motor 110 and brake 114 and through the control of the motor 110 and brake 114 controls the position and movement of the storage compartment 14 relative to the enclosure 18.

Controller 118 is coupled to various sensors and actuators. Illustratively actuators include the wall mounted keypad 186 and the wireless remote control 180. Wireless remote control 180 includes the transmitter 182 remotely located from the controller 118 and a receiver 184 located within the control box and coupled to the controller 118. The transmitter 182 and receiver 184 communicate wirelessly, e.g. through electromagnetic signals such as radio, infrared, ultraviolet or microwaves or through sonic or ultrasonic signals. Wireless remote control 180 is configured to provide a signal to the controller 118 upon depression of a button of the transmitter 182 by the user. The controller 118 is configured to stop the motor 110 upon receipt of a signal from the wireless remote control 180 if the motor 110 is currently turning either direction. If the motor 110 is not currently turning, the controller 118 is configured to start the motor 110 turning in the direction opposite the direction it was most recently turning anytime a signal is received from the wireless remote control 180. Illustratively, once the motor 110 is turning the controller 118 keeps it turning in the same direction until another signal is received to stop or reverse the motor 110. In the illustrated embodiment, such a signal could come from the wireless remote control 180, the keypad 186, the position limiter 192, or the touch bar 188. Thus, once the user has depressed the button on the transmitter 182, the button may be released so that the user does not have to keep the button depressed until the storage compartment 14 is fully opened (in the access position) or fully closed (in the storage position).

Those skilled in the art will recognize that wireless remote 180 can be configured so that the transmitter 182 includes multiple buttons each of which when actuated induces the transmitter 182 to send a distinguishable signal. Separate buttons and distinguishable signals could be provided to indicate the user's desire that the storage compartment 14 move upward, downward or be stopped. It is also within the scope of the disclosure for the controller 118 to be programmed to require continuous receipt of a signal for the motor 110 to continue to rotate requiring the user to depress a button on the transmitter 182 continuously until the storage compartment 14 reaches a desired location in its range of motion.

The controller 118 is illustratively programmed to respond to the keypad 186 in the same manner as it responds to the remote control 180. The controller 118 is illustratively programmed to recognize a signal from the keypad 186 only if such signal is sent within a specified time following the transmission of an authorized code sequence. Thus, a user may enter a code or PIN prior to actuating a send key on the keypad 186 to send a signal. Once a valid pin has been entered, the user can engage the send key on multiple occasions for a limited period of time to stop and reverse the motor 110.

Among the sensors to which the illustrated controller 118 is coupled are the upper limit indicator 194, the lower limit indicator 196 and the touch bar 188. As disclosed above, the upper limit indicator 194 is configured to send a signal to the controller 118 when the storage compartment 14 reaches the storage position. Also, the lower limit indicator 196 is configured to send a signal to the controller 118 when the storage compartment 14 reaches the storage position. In the illustrated embodiment, the upper and lower limit indicators 194, 196 are limit switches that switch from a first state to a second state when the limit is reached and remain in the second state so long as the storage compartment 14 remains in the limit position. Thus, controller 118 is programmed to halt the motor 110 upon the change from the first state to the second state. Additionally, since the illustrated embodiment activates the brake 114 each time current is not being provided to the motor 110, controller 118 actuates the brake 114 when the limit switch 194, 196 changes from the first to the second state. When a limit switch 194, 196 is in the second state, receipt of a signal from the keypad 186 or wireless remote 180 causes the controller 118 to drive the motor 110 in the opposite direction it was being driven prior to the change of the limit switch 194, 196 from the first state to the second state.

Figure 14:
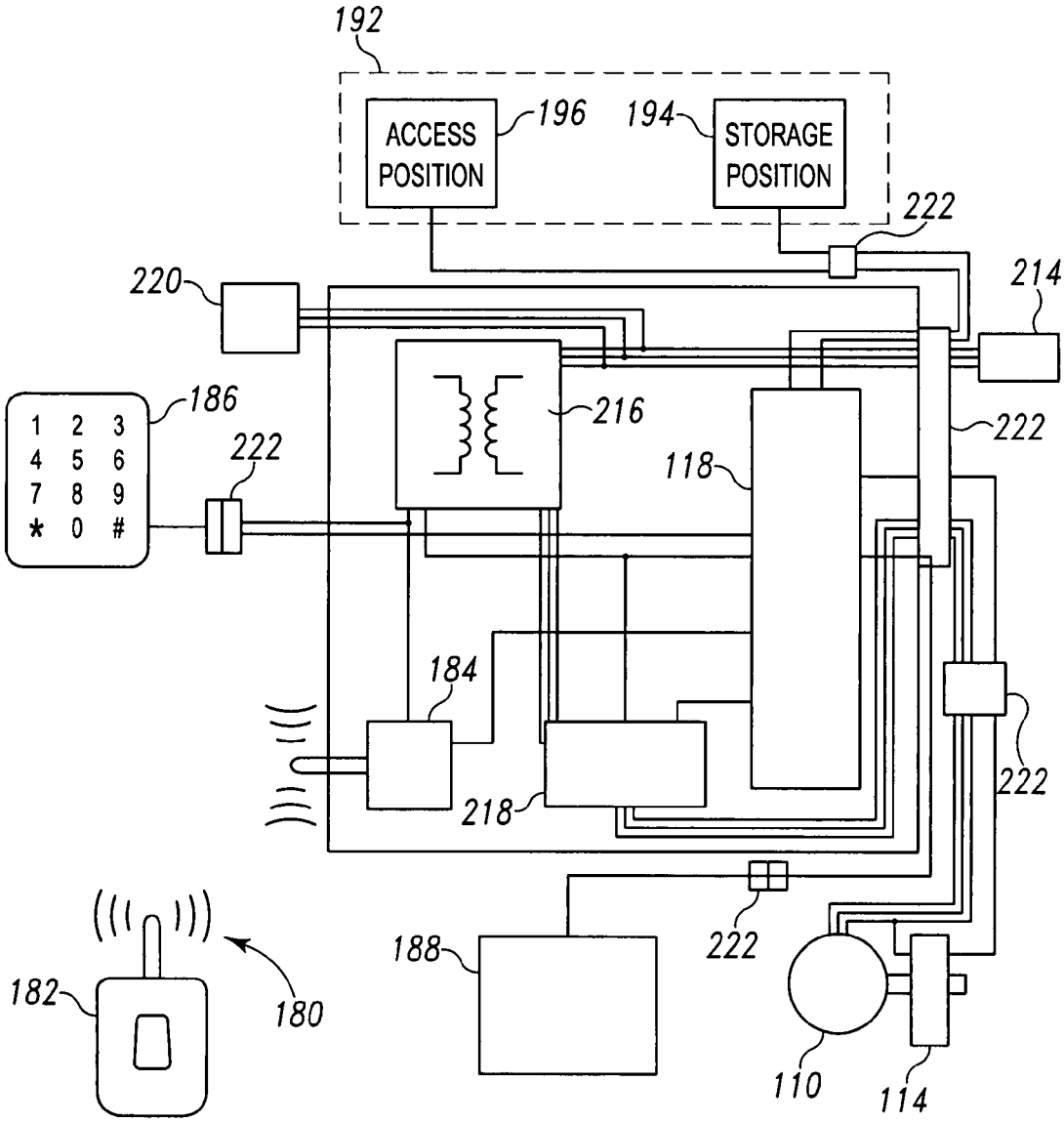
FIG. 14 is a block diagram view of the controller for the storage system, the sensors and switches communicating with the controller and the motor and brake controlled by the controller.

As shown, for example, in FIG. 14, control box is coupled to the power supply 214 of the building in which storage unit 10 is mounted. Illustratively 120 volts is supplied to the control box and sent to a transformer 216. Transformer 216 is configured to supply power from its secondary side to the various components in the control box including the receiver 184, motor driver 218 and programmable controller 118. Illustratively, 120 volts is provided from the primary side of the transformer 216 to the motor drive 218 to provide driving current to the motor 110. Motor driver 218 is an Aromat™ Motor Control Relay available from Indy Control, Beech Grove, Ind. capable of providing a driving current to drive motor 110 in a forward or reverse direction in response to a control signal received from the controller 118. Those skilled in the art will recognize that other motor drivers 218 may be used within the scope of the disclosure and that the selection of the appropriate motor driver 218 will be somewhat dependant on the selection of the motor 110.

As shown, for example, in FIG. 14, 120 volts is provided to a receptacle 220 for providing power to devices mounted in or associated with the storage unit 10, such as lights, refrigerators, televisions or other electric or electronic devices. Additionally, connectors 222 are provided between the control box and the various sensors and actuators to allow components to be easily replaced within the storage system 10.

In an alternative embodiment of the storage compartment 14, a spring (not shown) biases the linkage arm 34 toward the access position. During initial movement of the storage compartment 14 from the stored position toward the access position, a nudge or jolt might induce the guide wheels 80 extending from the bottom of the rear of the shelf 26 to start moving upwardly with respect to the back wall 36 of the frame 24, rather than downwardly, resulting in the shelf 26 not remaining parallel to the ground or ceiling. In order to avoid such a situation, a spring may bias the linkage arm 34 toward the access position (i.e. toward the bottom of the frame 24) to ensure that initial movement of the shelf 26 during the transition from the storage to the access position is in the appropriate direction. Among the mechanisms that can induce the initial movement of the shelf 26 in the appropriate direction are an extension spring coupled between the shelf 26 or the linkage arm 34 and the storage compartment 14 which is stretched during movement of the storage compartment 14 toward the storage position. A compression spring configured to engage the shelf 26 or the linkage arm 34 during movement of the storage compartment 14 toward the storage position may also be used. A spring valence that is wound during movement of the storage compartment 14 toward the storage position may also be utilized to induce movement of the shelf 26 in the appropriate direction. Those skilled in the art will recognize that other mechanisms may be used to induce movement of the shelf 26 in the appropriate direction. Once the initial movement is in the correct direction the weight of the shelf 26 and the objects thereon will ensure that the wheels 80 continue to move in the appropriate direction with respect to the back wall 36 of the frame 24. As previously stated, it is envisioned that the guide wheels 80 will ride on the back wall 36 of the frame 24 throughout the range of motion of the storage compartment 10.

Figure 8:
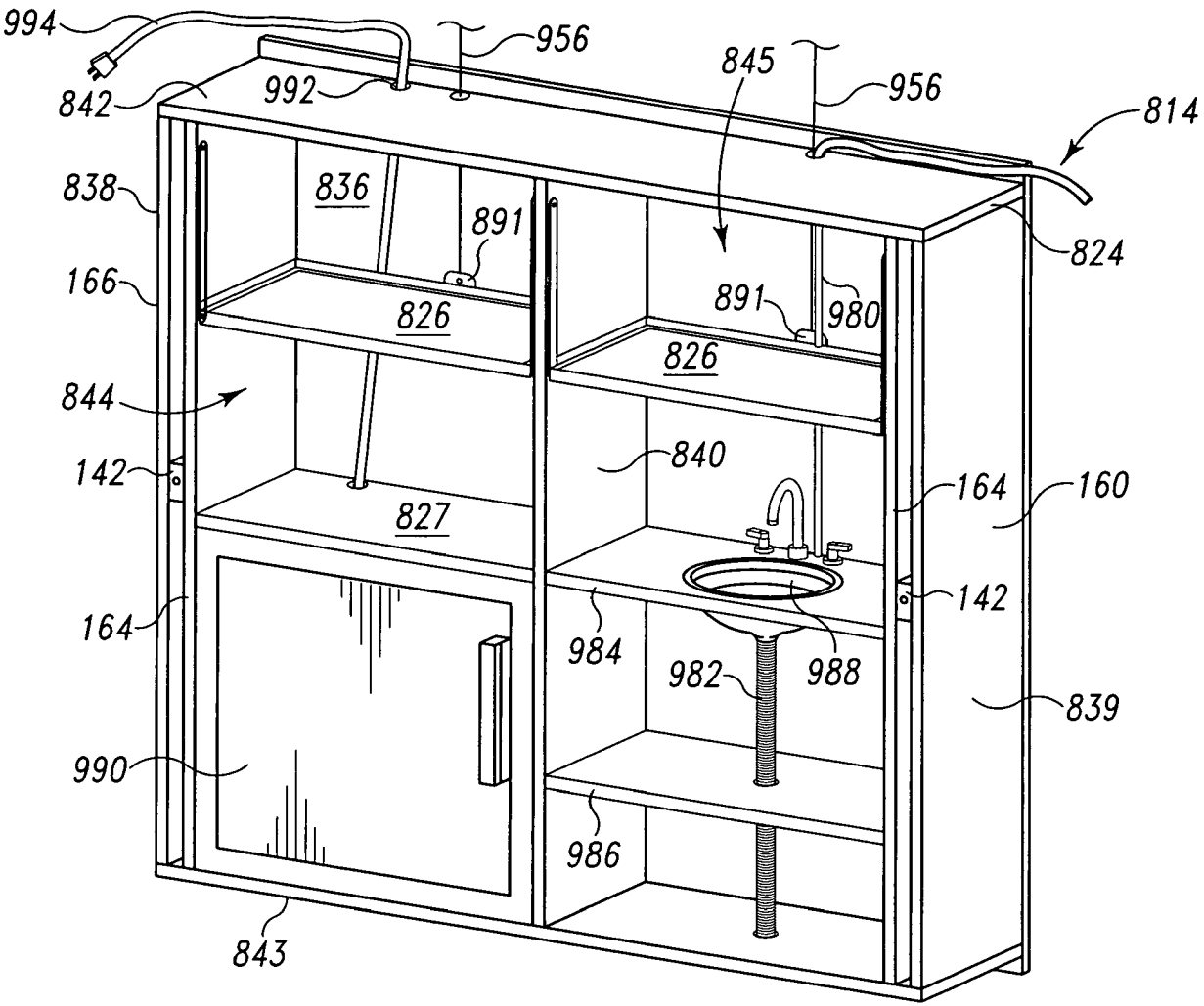
FIG. 8 is a perspective view of the storage compartment of a second embodiment of a storage system wherein the storage system acts as a stow away wet bar.
Figure 10:
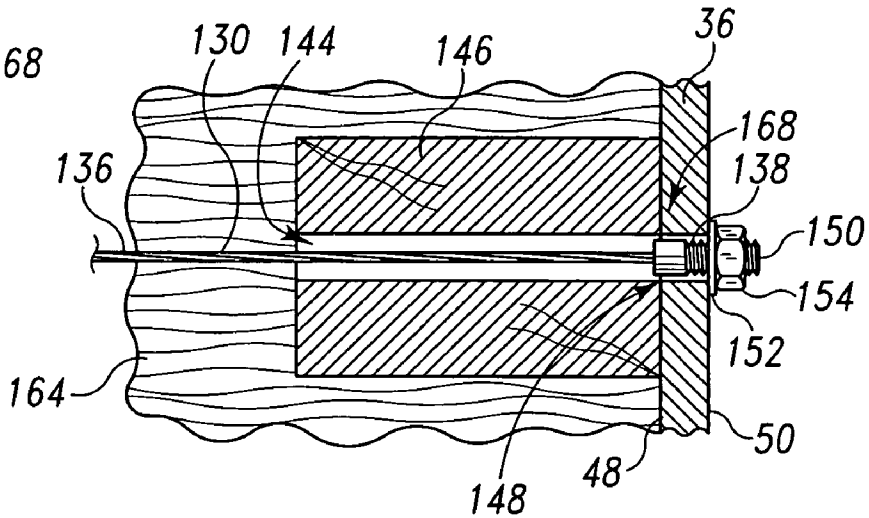
FIG. 10 is a sectional view of the rear block and back wall of the release mechanism showing a threaded rod crimped to the end of the lift cable and extending through the back wall of the frame of the storage compartment and a washer and nut removably secured to the threaded shaft.
Figure 9:
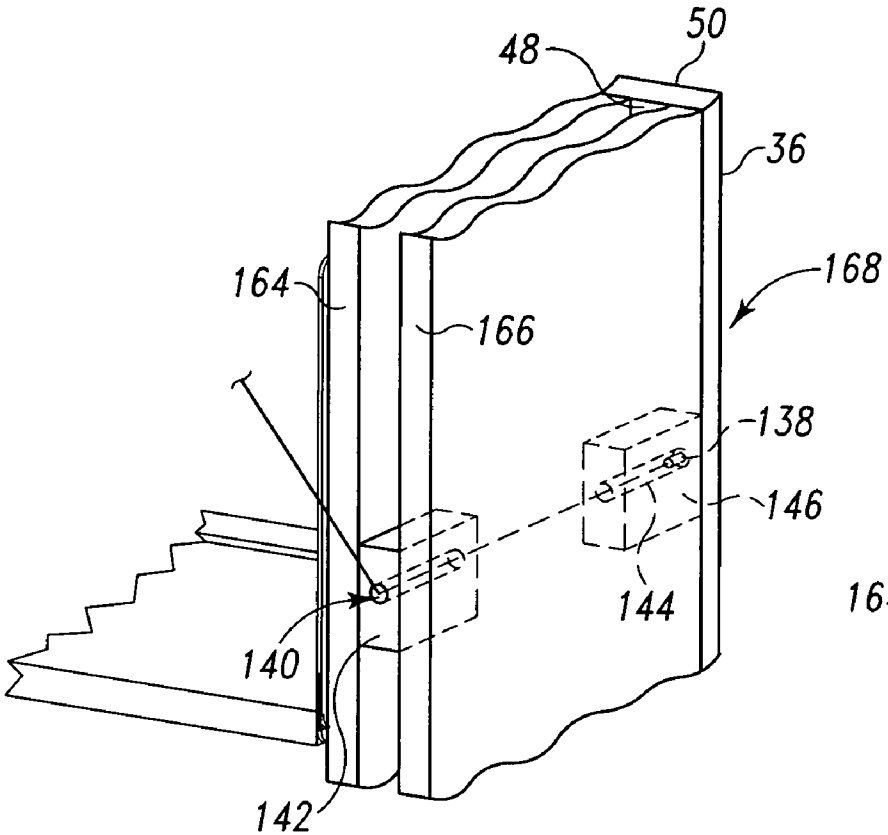
FIG. 9 is a perspective view of a cable mount configuration showing a lift cable extending through lumens of blocks between double walled side walls of the storage compartment to provide a release mechanism for the storage compartment in the event of a motor or power failure.

As shown, for example, in FIG. 8, the storage compartment 814 of a storage system 10 may be formed to serve as a wet bar. The storage compartment 814 of the wet bar includes only a single divider wall 840 forming two compartments 844, 845 The sidewalls 838, 839 of storage compartment 814 are illustrated as including the double wall construction with support blocks 142, 144 therebetween. A more detailed depiction of the support blocks 142, 144 and double wall construction is shown, for example, in FIGS. 9 and 10.

In the wet bar embodiment of storage system 810, only a single shelf 826 in each compartment 844, 845 is mounted for pivotal movement relative to the frame 824. Such shelves 826 may be used for the storage of liquor bottles, bar tools, mixers and glass wear. Since only a single shelf 826 is present in each compartment, the shelf linkage arm 34 is eliminated in the wet bar arrangement and replaced with a hinge 891 mounted directly to the shelf 826. However, it is within the scope of the disclosure for two rotatable shelves to be present within a single compartment of the wet bar storage compartment and for there to be a linkage arm 34 coupling those shelves.

In one compartment 844 of the wet bar configuration 810 a small refrigerator 990 is provided mounted between the bottom end wall 843 and a fixed shelf 827. Fixed shelf 827 and top end wall 842 are formed to include holes 992 through which the electrical supply cord 994 of the refrigerator passes, as shown, for example, in FIG. 8. Electrical supply cord 994 passes between the rear wall of pivotable shelf 826 and the back wall 836 of the frame 824 of storage compartment 814. Control box is configured to include an outlet coupled to the 110V 15 Amp power circuit running into the control box into which the electrical supply cord 994 of the refrigerator 990 is plugged. It is within the scope of the disclosure for an electrical outlet to be placed in one of the compartments 843, 844 of the storage compartment 814 to provide electrical service to the refrigerator 990 or other items, such as a blender, that might be utilized with the wet bar.

It is anticipated that items requiring refrigeration will be removed from the wet bar 810 when not entertaining so the refrigerator 990 need not pivot relative to the frame 824. However, it is within the scope of the disclosure for the refrigerator 990 to be mounted for pivotal movement relative to the frame 824. Additionally, it is within the scope of the disclosure for shelves within the refrigerator 990 to be configured to pivot relative to the refrigerator side walls and for a shelf cable 956 to extend through the top wall of the refrigerator 990 to induce such rotation.

The second compartment 845 of the wet bar 810 includes a fixed sink shelf 984 and an additional drain shelf 986, both of which are illustrated as being fixed relative to the frame 824 of the storage compartment 814. A sink 988 is mounted in the sink shelf 984. Flexible water tubing 980 coupled at one end to the household water supply (not shown) extends through the top end wall 842 of the compartment and runs along the back wall 836 behind the pivotal shelf 826 and through the sink shelf 984 to supply water to the sink 988. A flexible drain line 982 is coupled to the tail pipe of the sink 988 and extends through the holes formed in the fixed drain shelf 984 and the bottom end wall 843 of the frame 824 of the storage compartment 814.

It is envisioned that the wet bar storage system 810 would be mounted in or to the ceiling 12 of a room containing a floor drain into which the end of the flexible drain pipe 982 would be installed. The floor drain would preferably include a removable cover that would obscure the drain when the wet bar 810 is not in use and a trap located below the floor to prevent sewer gasses from entering the room. It is within the scope of the disclosure to provide the water lines 980 with a solenoid actuated valve which is closed whenever the storage compartment 814 is not in the access position.

An entertainment center storage system 1110 is shown, for example, in FIG. 11. Entertainment center storage system 1110 includes alternative embodiments of the enclosure 1118 and the pivot drive mechanism 1122 that are similar to the enclosure 18 and pivot drive mechanisms 22 described with regard to storage system 10. Thus, identical or similar reference numerals will be used to describe the components of entertainment center storage system 1110 as were used in the description of storage system 10.

In the illustrated the motor 1210, gear box 1212 and brake 1214 are mounted to the exterior of the enclosure 1118. Bearing 1220 are mounted in holes in the side walls of enclosure 1118 within which ends of shaft 1216 are received. This external mounting of motor 1210, gear box 1212 and brake 1214 allow enclosure to be formed with a lower height.

As shown, for example, in FIG. 11, the storage compartment 1114 of a storage system 10 may be formed to serve as an entertainment center. The storage compartment 1114 of the entertainment center includes two divider walls 1140, 1141 forming three compartments 1144, 1145, 1146. The sidewalls 1138, 1139 of storage compartment 1114 are illustrated as including the double wall construction with support blocks 142 therebetween. A more detailed depiction of the support blocks 142 (and obscured support block 144 and double wall construction is shown, for example, in FIGS. 9 and 10.

In addition to compartments 1114, 1115, 1116, back wall 1126 is extended beyond side wall 1136 to provide a cover 1109 for a motor receiving cavity 1107 formed adjacent to enclosure 1118. The cover 1109 and cavity 1107 facilitate mounting motor 1210, brake 1214 and gearbox 1212 outside of the enclosure 1118 facilitating usage of a lower profile enclosure 1118.

In the entertainment center storage system 1110, compartment 1146 is substantially identical to compartment 46 of storage system 10. However shelves 26 in compartment 1146 hold a tuner or CD player and racks of CD's, items which would not typically be found in a kitchen cupboard. Compartment 1144 of entertainment center 1110 is substantially identical to compartment 44 of kitchen cupboard 10, however supports 1126 in entertainment center include a front wall and higher retainer walls 1178 than are found on shelves 26 in cupboard 10. Alternative supports 26, such as drawers having a supporting surface 74 that remains in a substantially constant orientation relative to the floor or ceiling during pivotal movement of the storage compartment 1114, are within the scope of the disclosure. Compartment 1145 contains only a single shelf 1146 mounted for pivotal movement relative to the frame 1124. Shelf 1126 may be used for the storage of a stereo system or speakers of a surround sound system as shown, for example, in FIG. 11. Since only a single shelf 1126 is present in compartment 1145, the shelf linkage arm 34 is eliminated in that compartment of the entertainment center arrangement and replaced with a hinge 1191 mounted directly to the shelf 1126.

In compartment 1145 of the entertainment center configuration 1110 a television 1290 is provided mounted between the bottom end wall 1143 and a pivotable shelf 1126. A power line 1292 extending to a power strip, not shown, extends behind pivotable shelf 1126 and through a hole 1192 formed in tope end wall 1142. The power line couples to the control box which is coupled to the power supply of the structure in which the storage system 110 is mounted. Control box is configured to include an outlet coupled to the 110V 15 Amp power circuit running into the control box into which the power line 1292 of the power strip is plugged. Any electrical device in the entertainment center 1110 may be powered from power strip.

Although specific embodiments of the invention have been described herein, other embodiments may be perceived by those skilled in the art without departing from the scope of the invention as defined by the following claims.

What is claimed is:

1. A storage system for mounting to a ceiling or overhead structure of a building having a water supply and a drain, the storage system comprising:

a mounting frame, a portion of which is disposed adjacent the ceiling or overhead structure;

a storage compartment coupled to the mounting frame for movement relative to the ceiling or overhead structure between an access position and a storage position;

a lift mechanism coupled to the storage compartment and configured to move the storage compartment between the access position and the storage position;

a sink mounted to the storage compartment; and water supply lines extending between the sink and the water supply to provide water to the sink, wherein the storage compartment is configured for pivotal movement between the access position and the storage position, further comprising:

at least one shelf having a support surface, said at least one shelf being mounted to the storage compartment for pivotal movement relative thereto; and a tilt mechanism coupled to the shelf and configured to maintain the support surface of the shelf in a substantially consistent orientation relative to the ceiling when the storage compartment is in the access position, the storage position and positions between the access and storage positions.

2. The storage system of claim 1 further comprising:

an actuator configured to drive the lift and tilt mechanisms to move the storage compartment between the access and storage positions and maintain the relative orientation of the support surface of the shelf during such movement.

3. The storage system of claim 2 wherein the actuator is a motor and further comprising a shaft drivably coupled to the actuator for rotation thereby.

4. The storage system of claim 3 wherein the lift mechanism includes a lift coupler coupled to the shaft, the lift coupler being coupled at a first end to the frame and configured to wind about the shaft.

5. The storage system of claim 4 wherein the lift coupler is a cable removably affixed at the first end to the frame to facilitate removal of the coupler from the frame to permit the frame to pivot into the access position upon motor failure.

6. The storage system of claim 5 wherein the frame includes a back wall and at least one double side wall, the at least one double sidewall including an inner wall, an outer wall, and at least one block positioned between the inner wall and outer wall to provide a displacement between the inner wall and the outer wall, the at least one block of each sidewall including an opening configured to receive the lift coupler therethrough, the lift coupler being configured to extend through the opening in the at least one block to the back wall of the frame.

7. The storage system of claim 6 wherein the back wall includes an opening corresponding to the opening of at least one of the blocks, the lift coupler being configured for removable connection to the opening in the back wall.

8. A storage system for mounting to a ceiling of a building having a water supply and a drain, the storage system for selectably providing access to a space above a ceiling or overhead structure, the storage system comprising:

a storage compartment mounted to the ceiling for movement between a storage position wherein the storage compartment is disposed substantially within the space and an access position;

an actuator coupled to the storage compartment configured to drive the storage compartment between the access position and the storage position;

a sink mounted to the storage compartment;

water supply lines extending between the sink and the water supply to provide water to the sink;

at least one shelf having a support surface, said at least one shelf being mounted to the storage compartment for pivotal movement relative thereto; and a tilt mechanism coupled to the shelf and configured to maintain the support surface of the shelf in a substantially consistent orientation relative to the ceiling when the storage compartment is in the access position, the storage position and positions between the access and storage positions.

9. The storage system of claim 8 wherein the actuator is configured to drive the tilt mechanism to maintain the relative orientation of the support surface of the shelf during movement of the storage compartment.

10. A storage system for mounting to a ceiling or overhead structure of a building, the building having a water supply and a drain, the storage system comprising:

a storage compartment mounted to the ceiling or overhead structure for movement relative to the ceiling or overhead structure between an access position and a storage position;

a sink mounted to the storage compartment; and water supply lines extending between the sink and the water supply to provide water to the sink;

a lift mechanism coupled to the storage compartment and configured to pivotally move the storage compartment from the access position to the storage position;

at least one shelf having a support surface, said at least one shelf being mounted to the storage compartment for pivotal movement relative thereto; and a tilt mechanism coupled to the shelf and configured to maintain the support surface of the shelf in a substantially consistent orientation relative to the ceiling when the storage compartment is in the access position, the storage position and positions between the access and storage positions.

11. The storage system of claim 10 further comprising:

an actuator configured to drive the lift and tilt mechanisms to move the storage compartment between the access and storage positions and maintain the relative orientation of the support surface of the shelf during such movement.

* * * * *